United States Patent [19]

Varshneya

[11] Patent Number: 4,539,509

[45] Date of Patent: Sep. 3, 1985

[54] QUARTZ TO METAL SEAL

[75] Inventor: Arun K. Varshneya, Alfred, N.Y.

[73] Assignee: General Electric Company, Schenectady, N.Y.

[21] Appl. No.: 450,576

[22] Filed: Dec. 17, 1982

[51] Int. Cl.[3] ..... H01J 5/36; H01J 61/36; H01K 1/38

[52] U.S. Cl. ..... 313/623; 313/636; 313/315; 501/21; 501/49

[58] Field of Search ..... 313/636, 623, 579, 315; 501/49, 15, 77, 10, 21; 428/432, 433, 426, 428; 174/50, 50.64

[56] References Cited

U.S. PATENT DOCUMENTS

| | | | |
|---|---|---|---|
| 3,211,826 | 10/1965 | Holcomb et al. | 174/50.64 |
| 3,446,637 | 5/1969 | Earl | 501/15 |
| 3,588,315 | 6/1971 | Levand, Jr. et al. | 501/15 X |
| 3,868,528 | 2/1975 | Lake et al. | 313/220 |
| 4,105,826 | 8/1978 | Thomas | 428/379 |
| 4,277,285 | 7/1981 | Boudot | 501/74 |
| 4,441,051 | 4/1984 | Thomas | 313/636 X |

*Primary Examiner*—David K. Moore
*Assistant Examiner*—K. Wieder
*Attorney, Agent, or Firm*—J. F. McDevitt; Philip L. Schlamp; Fred Jacob

[57] ABSTRACT

A lead-free sealing glass consisting essentially of, in parts by weight, 8–25 BaO, 20–35 $B_2O_3$, and 45–72 $Sb_2O_3$ except for incidental impurities, residual fluxes and refining agents provides an improved molten sealing action especially useful for high temperature electric lamp envelopes and other electrical devices. More particularly, a protective molten seal utilizing said sealing glass is formed between a refractory metal inlead which extends into a larger sized opening of a fused quartz member by filling the free space between said opening in the fused quartz member and the refractory metal inlead with the aforementioned sealing glass composition and thereafter converting the sealing glass to a molten condition during device operation.

1 Claim, 2 Drawing Figures

QUARTZ TO METAL SEAL

BACKGROUND OF THE INVENTION

This invention relates generally to seals between metal lead-in conductors and fused quartz or fused silica for electrical devices having a sealed envelope with electric current being supplied to electric energy translation means located within the sealed envelope through said lead-in conductors. More particularly, the present invention employs an improved sealing glass composition to provide a novel molten seal between a fused quartz member which is pinch-sealed to a refractory metal inlead that has been inserted into an opening provided in the fused quartz member. Specifically, said improved sealing glass composition melts at elevated temperatures above about 350° C. when the electrical device is operated and provides a molten seal around the inleads which serves to protect against oxidation or contamination of these parts. At ordinary temperatures, however, this sealing glass solidifies to a crazed or frit condition in the opening due to its higher thermal expansion than the thermal expansion of the refractory inlead metal.

Pinch seals are known and commonly employed with various type electric lamps being operated at elevated temperatures up to 500° C. and higher, hence require that a transparent envelope material be employed which is capable of withstanding the operating temperatures. It is also commonly required that said lamp envelopes further be sealed directly to the electrical inlead components, such as now practiced in commercial incandescent type quartz heating lamps as well as discharge lamps to include regenerative cycle halogen and other type discharge lamps. In achieving this latter objective with refractory metal inleads, it is generally required that very thin flat foils be used to preserve a hermetic seal during extended periods of lamp operation. In U.S. Pat. No. 3,211,826, which is assigned to the assignee of the present invention, there is disclosed a representative quartz to metal seal of the type being employed in a commercial quartz infrared lamp. There is also disclosed in another U.S. Pat. No. 3,868,528, assigned to the present assignee, a representative metal halide discharge lamp employing the same type pich-seal construction.

It has now also become desirable to remove lead as well as arsenic from glass materials employed in consumer products to avoid the ecological problems associated with these substances. Accordingly, it is an object of the present invention to provide a lead-free sealing glass composition which enables a novel molten seal to be formed between a refractory metal lead-in conductor and fused quartz when the electric lamp is being operated. It is a further object of the present invention to provide a substitute sealing glass devoid of both lead and arsenic which does not require that a substantial modification be made in the otherwise conventional pinch seal construction of an electric lamp. In achieving these objectives with molybdenum and tungsten lead-in conductors, it is especially critical that oxidation of said metals be avoided by protective action of the sealing glass employed since the seal temperatures often exceed 500° C. and higher during operation of the current lamps.

SUMMARY OF THE INVENTION

It has now been discovered that a particular sealing glass composition provides a novel molten sealing action in the electric lamps disclosed in both above-mentioned prior art patents. More particularly, an improved hermetic seal construction is provided between a refractory metal inlead which extends into a larger size opening of a fused quartz member by filling the free space between said opening in the fused quartz member and the refractory metal inlead with a sealing glass consisting essentially of in parts by weight 8–25 BaO, 20–35 $B_2O_3$, and 45–72 $Sb_2O_3$ except for incidental impurities, residual fluxes and refining agents, said sealing glass being molten at elevated temperatures above about 350° C. and having a thermal expansion greater than said refractory metal inlead. In said improved seal construction, the hermetic seal is necessarily formed directly between the refractory metal inlead and the fused quartz member due to the expansion mismatch of the particular sealing glass being employed.

For an improved quartz infrared lamp construction according to the present invention, there can be employed a tubular envelope of quartz having an incandescible filament of coil tungsten wire extending longitudinally therethrough and connected at each end to lead-in conductors which are hermetically sealed through compressed or pinched seal portions at the end of the envelope. Said lead-in conductors can employ tungsten or molybdenum metal wire for the inner lead which can be secured to a very thin intermediate foliated or ribbon portion of molybdenum that becomes wetted and hermetically sealed when the pinch seal is formed at elevated temperatures. In a preferred discharge lamp construction of the present invention, the lead-in conductors comprise an outer lead wire, a foil element, and inner lead which are sealed at both ends of the quartz lamp envelope at the pinch seal portions. A tungsten wire electrode can be wound about the inner lead of each lead-in conductor for coating with an electron emissive activating material to serve as the discharge electrodes in said lamp construction.

DESCRIPTION OF THE PREFERRED EMBODIMENTS

Figure 1:
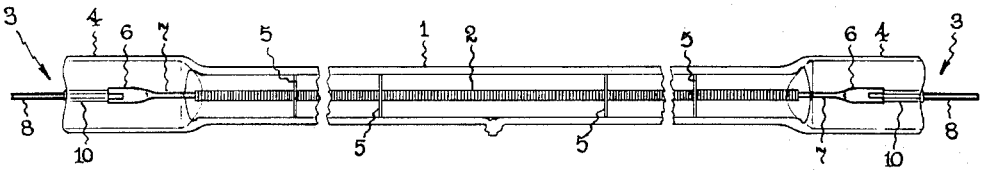
FIG. 1 is an elevation of a quartz infrared lamp embodying seals in accordance with the invention.

Referring to FIG. 1, a respesentative quartz infrared lamp is illustrated which comprises an elongated tubing envelope 1 of fused quartz or silica, preferably either crystal quartz or translucent sand quartz. A helically coiled tungsten filament 2 extends axially the length of the envelope 1 and is suitably connected at its ends to lead-in conductors 3 which are sealed through flattened press or pinch seal portions 4 at each end of the envelope. The elongated filament 2 is supported from the envelope wall at spaced points along its length by suitable support members 5 preferably tantalum discs and with said envelope being preferably filled with an inert gas at above atmospheric pressure, for example argon. The actual hermetic seal between the quartz seal portion 4 and the lead-in conductor 3 is at an extremely thin intermediate ribbon or foliated portion 6, preferably of molybdenum. The intermediate foliated portion 6 may be composed of a separate piece of molybdenum foil welded at opposite ends to the ends of respective inner and outer lead portions 7 and 8, or said foliated portion 6 may be formed as an integral part of a molybdenum inner lead portion 7 by flattening a part of the lead portion to a thickness between about 0.0005 to 0.001 inch by longitudinal rolling, in the conventional fashion. It should be understood that because the difference in thermal expansion of the quartz and the relatively heavy outer lead portion 8, there is a slight space or passage between the quartz and the part of the outer lead portion enclosed therin through which atmospheric air can reach the outer end of the foil portion 6. At the seal temperatures of lamp operation which reach at least 350° C. and higher, oxidation of the refractory metal foil 6 can produce lamp failure unless the aforementioned open space is filled with a protective seal glass material. Accordingly, a bead or tube of said material 10 can be placed in this cavity for subsequent melting when the pinch sealing operation is conducted, all in a conventional manner.

As previously indicated, the present invention resides primarily in discovering a novel molten sealing action attributable to employment of a particular sealing glass composition which protects against seal failures in the above type lamps to a degree at least comparable with prior art sealing glasses. Sample lamps of the above design were thereby tested for comparison with a conventional seal glass having 75% PbO, 13% $B_2O_3$, 3% $SiO_2$, 3% $F_2$, 2% $TL_2O_3$, along with other minor constituents. The present seal glass employed in these test lamps consisted of 9.9% BaO, 24.6% $B_2O_3$, and 65.5% $Sb_2O_3$, along with a comparable minor constitutents. A group of four test lamps in each category were operated under the same test conditions which produced a significantly lower failure rate for the present lamps. Such improved resistance to inlead oxidation is not believed to extend to ambient temperature environments, however, since the present sealing glass was observed to exist as a frit in the pinch seal cavity at ordinary temperatures.

Figure 2:
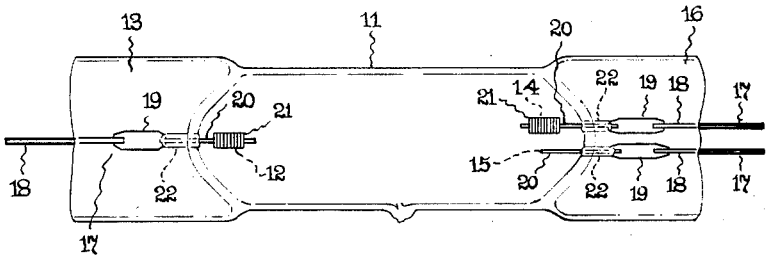
FIG. 2 represents an arc tube of one type general lighting metal halide lamp embodying the invention.

In FIG. 2 there is illustrated a representative metal halide lamp arc tube 11 having a single electrode 12 pinch-sealed into one end 13 and a main electrode 14 along with an auxiliary starting electrode 15 pinch-sealed at the other end 16. Each of said electrodes include refractory metal inleads 17 having an outer molybdenum wire 18, a thin molybdenum sealing foil 19, and an inner tungsten wire lead 20. The tungsten lead 20 sometimes known as the electrode shank, has its distal end overlaid by a double wound coil 21 of tungsten wire serving as the electrode proper. Some metal halide lamps rely upon alkali metal halides disposed in the envelope as the ionizing filling for electrode activation, whereas others include a quantity of electron emissive activator material which may be retained within the electrode coil in a conventional manner, for instance in the interstices between the two layers of the coil. As can be further noted from the drawing, a fillet of sealing glass material according to the present invention is located at 22 to serve as a means for protecting the foil element 19 from corrosion by the atmosphere existing in said arc tube 11 during lamp operation. By filling the free space between the opening in the quartz arc tube and the inner tungsten lead with the present sealing glass material in this manner, it becomes possible to avoid a severe corrosion problem during lamp operation when the adjoining molybdenum foil element becomes physically contacted with alkali halide which leaks from the sealed arc tube.

It will be apparent from the foregoing description that a generally useful sealing glass composition has been disclosed for use in providing an improved hermetic seal between a refractory metal inlead and a fused quartz member in various electrical devices especially electric lamps. It will be apparent, however, that minor modifications can be made in said sealing glass composition without deleterious effect upon the physical properties required for sealing to refractory metals. Additionally, it is further contemplated to employ the present sealing glass material in other high temperature electric lamp designs other than above specified which include hermetic sealing of the lead-in conductors. Accordingly, it is intended to limit the present invention only by the scope of the following claims.

What I claim as new and desire to secure by United States Letters Patent is:

1. An electric lamp wherein seal temperatures exceed 500° C. during lamp operation and subject the seal parts to both oxidation and contamination comprising:

a fused quartz tubular envelope having a molybdenum inlead construction pinch-sealed into both ends extending into said ends through openings extending into said envelope, said molybdenum inlead construction consisting essentially of an inner molybdenum wire inlead flattened at its outer end to form a thin foil and with said foil portion being connected to an outer molybdenum terminal wire lead of larger diameter than said inner wire inlead, and connected to the ends of a longitudically extending tungsten filement, and a sealing glass filling the space in said openings between the fused quartz and both outer terminal inleads, said sealing glass consisting essentially of, in parts by weight, 8–25 BaO, 20–35 $B_2O_3$, and 45–72 $Sb_2O_3$ except for incidental impurities, residual fluxes and refining agents, said sealing glass being molten at elevated temperatures above about 350° C. while solidifying to a frit condition at ordinary temperatures and having a thermal expansion greater than said molybdenum metal.

* * * * *